US007828597B1

(12) United States Patent
Jin et al.

(10) Patent No.: US 7,828,597 B1
(45) Date of Patent: Nov. 9, 2010

(54) ELECTRICAL CONNECTOR WITH TERMINAL GROOVES IN COMMUNICATION WITH EACH OTHER

(75) Inventors: Huo-Xing Jin, Kunshan (CN); Jian-Fei Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/713,191

(22) Filed: Feb. 26, 2010

(30) Foreign Application Priority Data

Oct. 12, 2009 (CN) ..... 2009 2 0312277

(51) Int. Cl.
*H01R 13/648* (2006.01)

(52) U.S. Cl. ..... 439/607.05; 439/701

(58) Field of Classification Search ..... 439/101, 439/108, 607.05, 701
See application file for complete search history.

(56) References Cited

U.S. PATENT DOCUMENTS 6,461,202 B2 * 10/2002 Kline ..... 439/701
6,764,342 B2 * 7/2004 Murayama et al. ..... 439/607.1
6,913,490 B2 * 7/2005 Whiteman et al. ..... 439/607.05
7,229,318 B2 * 6/2007 Winings et al. ..... 439/607.06

* cited by examiner

*Primary Examiner*—Tho D Ta
(74) *Attorney, Agent, or Firm*—Andrew C. Cheng; Wei Te Chung; Ming Chieh Chang

(57) ABSTRACT

Provided is an electrical connector including an insulative housing defining a plurality of terminal grooves therein and extending along a mating direction. A plurality of terminals are designated as signal terminals and grounding terminals and respectively received in said terminal grooves in a manner of two neighboring signal terminals adjacent to one grounding terminal which are designated as a terminal group. The grounding terminal and signal terminals which are in a same terminal group face to each other through a path defined therebetween so as to control impedance of the electrical connector.

8 Claims, 8 Drawing Sheets

ELECTRICAL CONNECTOR WITH TERMINAL GROOVES IN COMMUNICATION WITH EACH OTHER

BACKGROUND OF THE INVENTION

1. Field of the Invention

The present invention relates to an electrical connector, particularly, to an electrical connector with terminal grooves in communication with each other for controlling the impedance of the electrical connector.

2. Description of the Related Art

Systems facilitating high-speed data transfer require electrical connectors in which the electrical impedance can be controlled in order to reach the required data transfer rate of the electrical system. It is mandatory that within a high-speed data transfer system, the connector has to be kept with a controlled impedance such that the data transfer rate can be kept within the nominal ranges. The impedance of a connector may be controlled by spacing of the terminals (i.e. exposing partially of the contact terminal into the air), the dimension of the terminals and the thickness within the connector housing. Therefore, an improved electrical connector is highly desired to overcome the aforementioned problem.

SUMMARY OF THE INVENTION

Accordingly, an object of the present invention is to provide an electrical connector for controlling the impedance.

In order to achieve the object set forth, an electrical connector includes an insulative housing defining a plurality of terminal grooves therein and extending along a mating direction. A plurality of terminals are designated as signal terminals and grounding terminals and respectively received in said terminal grooves in a manner of two neighboring signal terminals adjacent to one grounding terminal which are designated as a terminal group. The grounding terminal and signal terminals which are in a same terminal group face to each other through a path defined therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
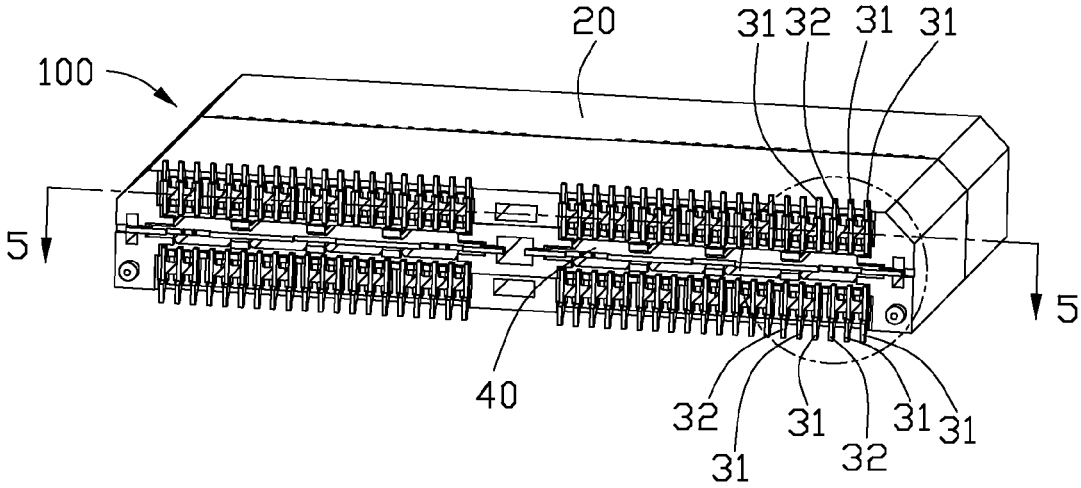
FIG. 1 is a perspective view of an electrical connector made in accordance with the present invention.
Figure 2:
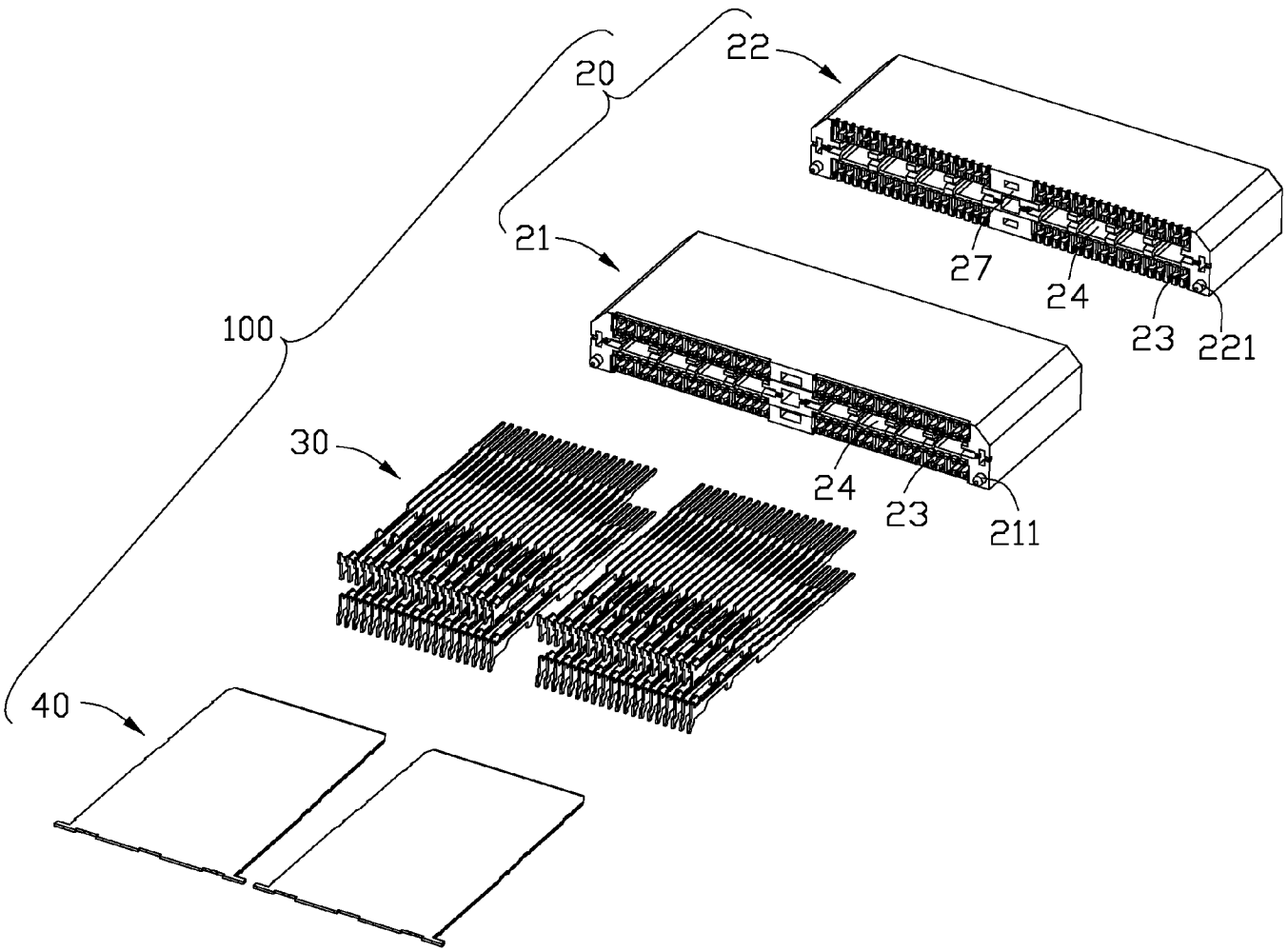
FIG. 2 is an exploded perspective view of the electrical connector shown in FIG. 1.

Reference will now be made to the drawing figures to describe a preferred embodiment of the present invention in detail. Referring to FIGS. 1 and 2, an electrical connector 100 made according to the preferred embodiment of the present invention is disclosed and comprises an insulative housing 20, a plurality of terminals 30 and a pair of metallic plates 40 received in the insulative housing 20.

Figure 3:
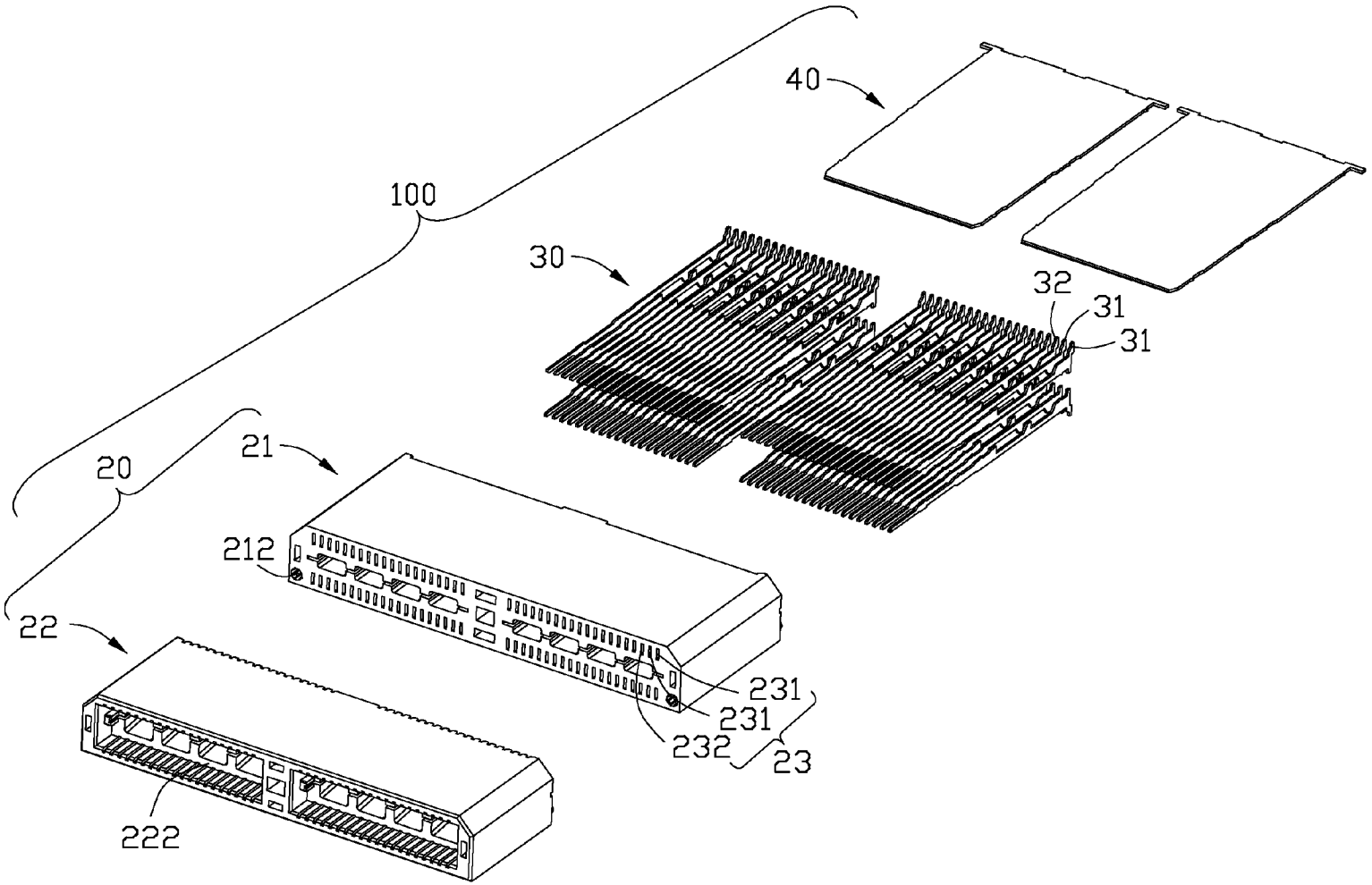
FIG. 3 is another exploded perspective view of the electrical connector shown in FIG. 1.

Referring to FIGS. 2 and 3, the insulative housing 20 comprises a first housing 21 for mounting onto a printed circuit board and a second housing 22 stacked to the first housing 21. Both of the first and second housings 21, 22 define a plurality of terminal grooves 23 located at opposite sides thereof and running through the first and second housings 21, 22 along a mating direction. The terminal grooves 23 are side-by-side arranged along a transverse direction perpendicular to the mating direction. Both of the first and second housings 21, 22 define a receiving space 24 therein for receiving said metallic plate 40. Each receiving space 24 is divided into two separate parts by a partition portion 27. The second housing 22 defines a pair of posts 221 on a rear portion and secured in apertures 212 defined on a front portion of the first housing 21 so as to combing the first and second housings 21, 22 together. A pair of posts 211 are also formed on a rear portion of the first housing 21 for securing the electrical connector 100 on the printed circuit board. A pair of tongue plates 222 are formed in the front portion of the second housing 22 for cooperating with a complementary mating connector (not shown).

Figure 4:
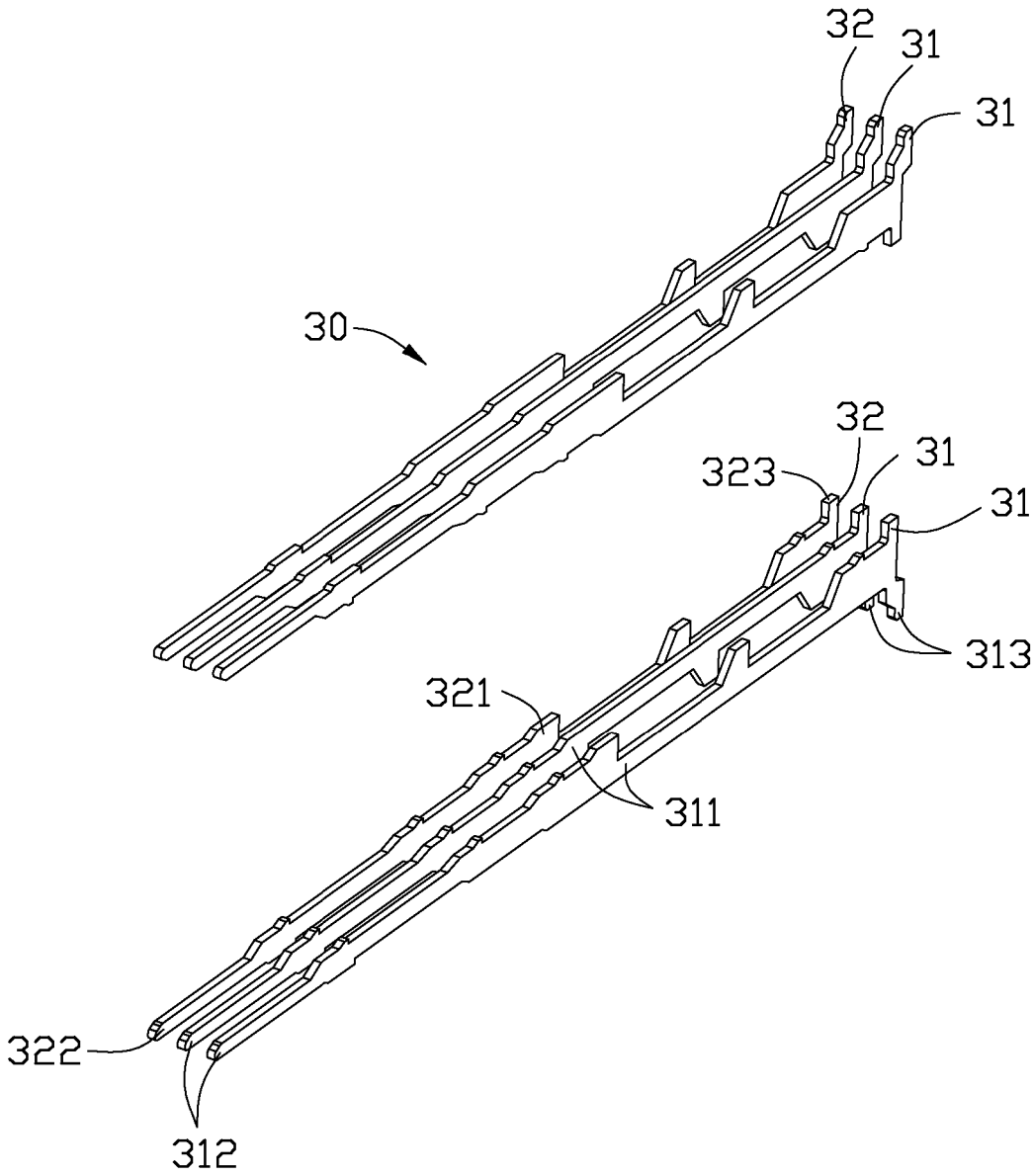
FIG. 4 is a perspective view of terminals of the electrical connector shown in FIG. 1.

Referring to FIGS. 3 and 4, the terminals 30 are arranged into two rows and respectively received in the terminals grooves 23. The terminals 30 are designated as signal terminals 31 and grounding terminals 32, wherein every neighboring signal terminals 31 are accompanying with a grounding terminal 32 so as to form a terminal group. Each signal terminal 31 and grounding terminal 32 comprise retaining portions 311, 321 secured in the insulative housing 30, contacting portions 312, 322 extending from one end of the retaining portion 311, 321, and solder portions 313, 323 extending from the other end of the retaining portion 311, 321.

Figure 5:
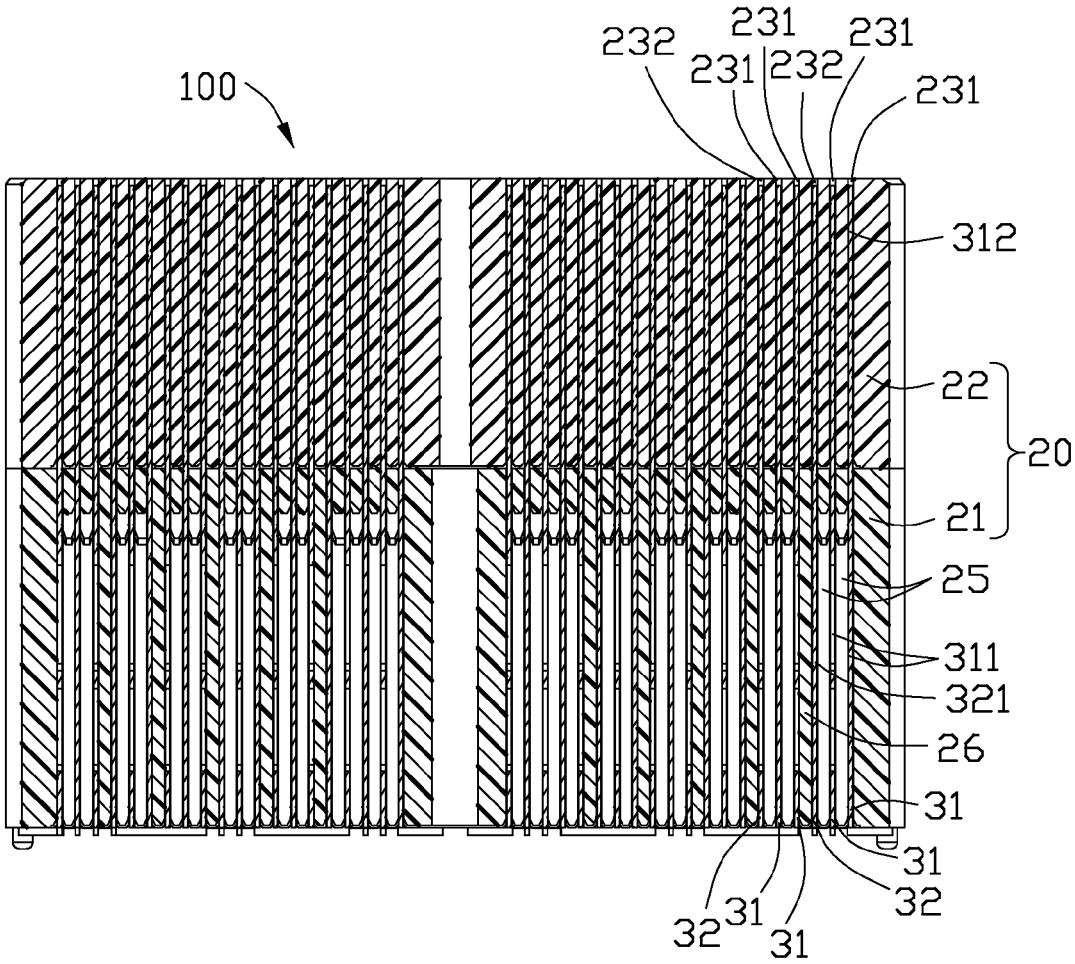
FIG. 5 is a cross-sectional view of the electrical connector shown in FIG. 1 along line 5-5.
Figure 6:
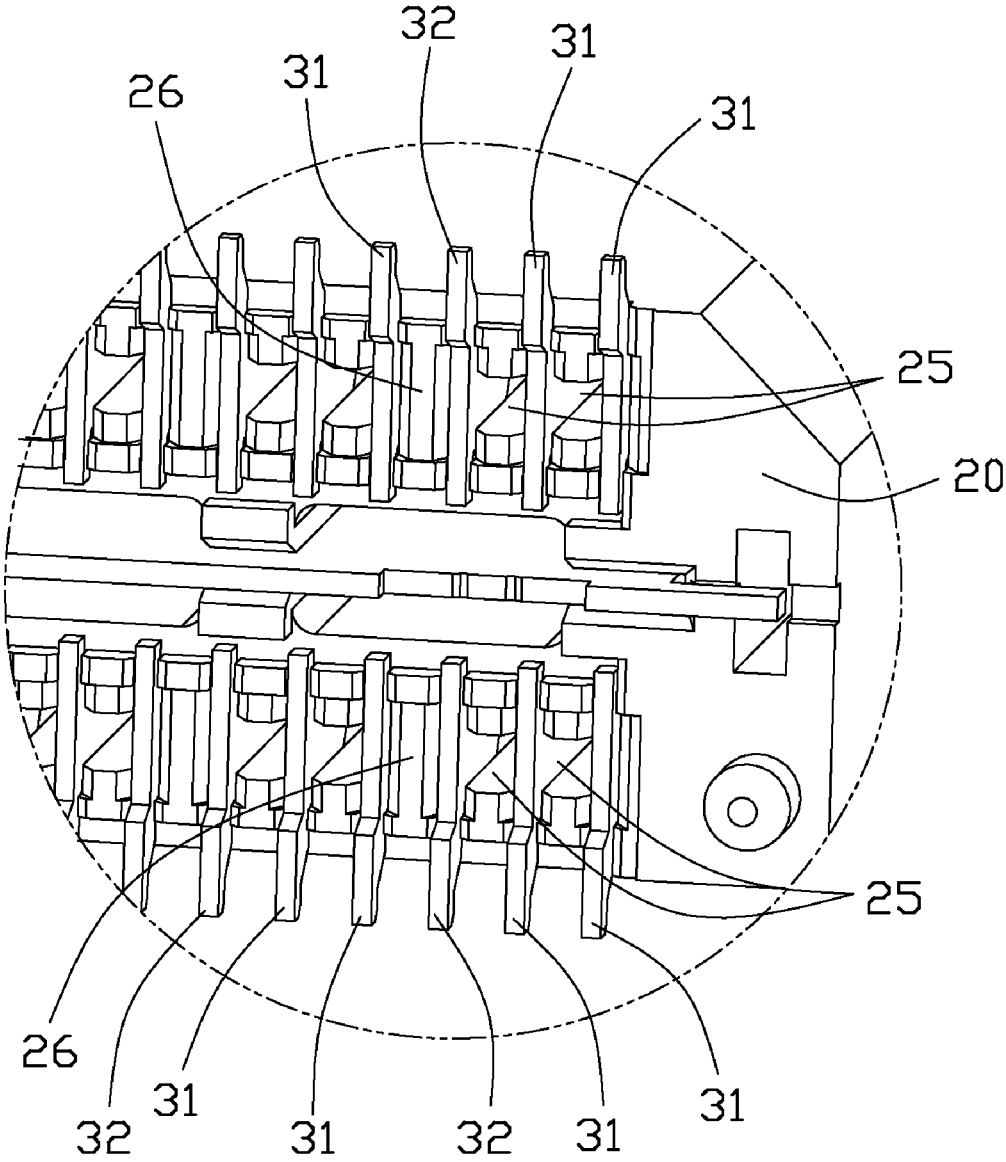
FIG. 6 is a partly-amplified view of the electrical connector shown in FIG. 1.

Referring to FIGS. 4-6, the terminal grooves 23 comprise first terminal grooves 231 for receiving the signal terminals 31 and second terminal grooves 232 for receiving the grounding terminals 32. A path 25 is defined between adjacent first terminal grooves 231 therefore the adjacent first terminal grooves 231 are in communication with each other. When the signal terminals 31 are inserted into the first terminal grooves 231, the retaining portions 311 of the neighboring signal terminals 31 will be face-to-face arranged partly, and the medium between the adjacent signal terminals changes into atmosphere from the original insulative material (plastic material in the present invention). As known, the dielectric constant of the atmosphere is lower than that of the plastic material, and the dielectric constant is inversely proportional to capacitance, therefore the capacitance between adjacent signal terminals 31 can be increased by the modification of the present invention. The impedance of the electrical connector is relative to the capacitance of the terminals, hence, the modification of the path 25 can turn the impedance of the electrical connector.

However, if every adjacent terminal groove 23 defines the path 25 therein, the rigidity of the insulative housing 20 will be weaken and can not provide a steadily and reliable retaining effect for the terminals 30. As described above, each terminal group comprises two signal terminals 31 and a grounding terminal 32, therefore a partition wall 26 can be arranged between adjacent terminal groups under condition that the path 25 is formed between every terminal 30 of the terminal group. The partition wall 26 can increase the rigidity of the insulative housing 20 and every terminal group is separated from each other by the partition wall 26.

Figure 7:
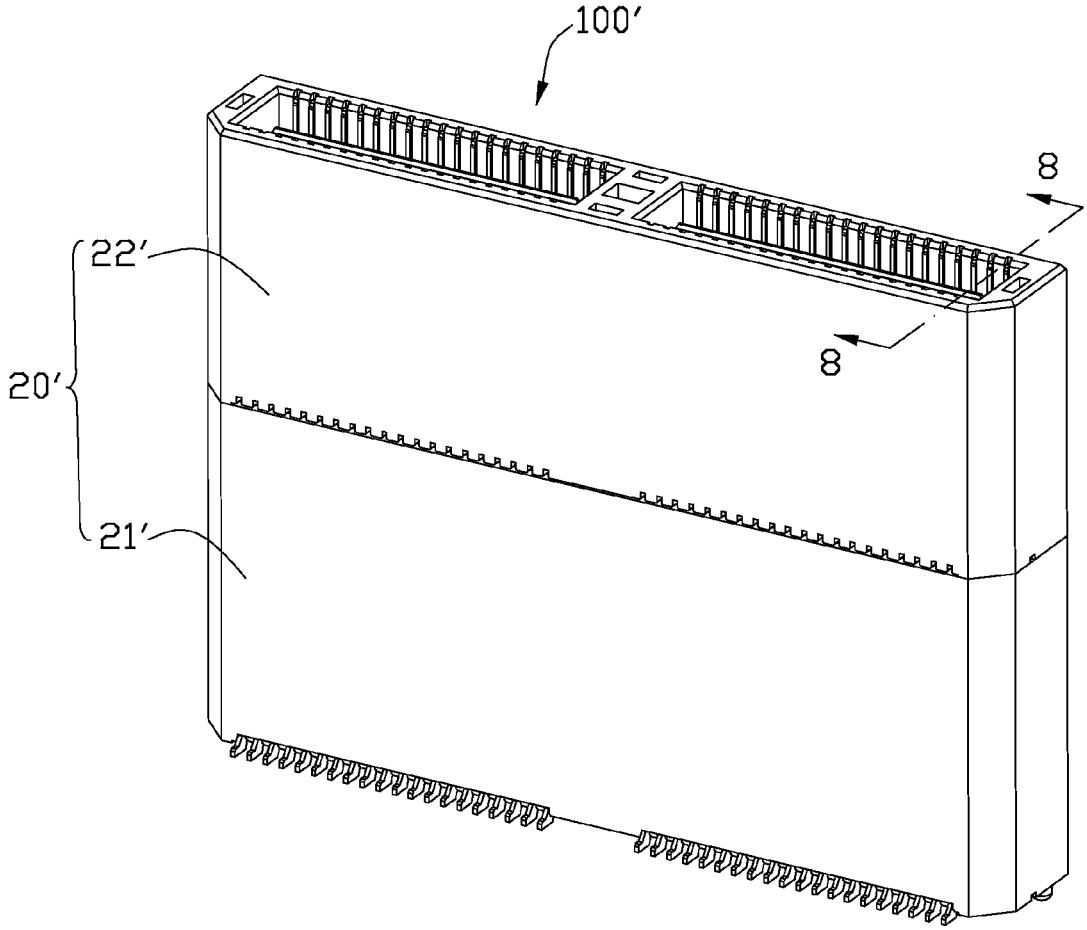
FIG. 7 is a perspective view of a second embodiment of the electrical connector.
Figure 8:
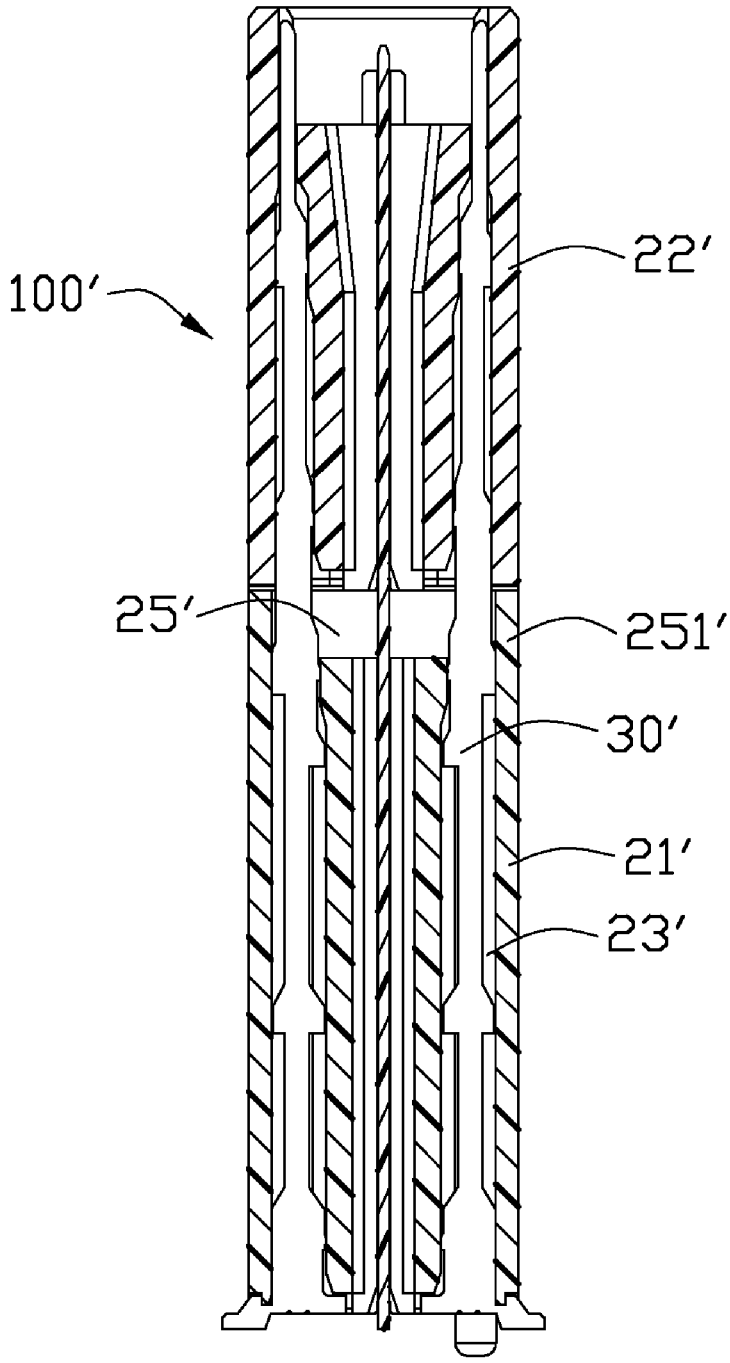
FIG. 8 is a cross-sectional view of the electrical connector shown in FIG. 7 along line 8-8.

Referring to FIGS. 7-8, a second embodiment of the electrical connector 100' according to the present invention is provided and comprises an insulative housing 20' with a plurality of terminals 30' retained therein. The insulative housing 20' is formed by a first housing 21' and a second housing 22' which are stacked together. A plurality of terminal grooves 23' are defined in the first and second housings 21', 22' for receiving said terminals 30' therein. Differently from the first embodiment, the insulative housing 20' defines a passageway 25' between the opposite side walls 251' and runs through the terminal grooves 23' along a transverse direction perpendicular to the mating direction, i.e., the passageway 25' runs across the terminal grooves 23'. As the width of the passageway 25' in the mating direction is limited, the rigidity of the insulative housing 20' will be not weakened. More importantly, the existence of the passageway 25' allows the adjacent terminal grooves 23' to communicate with each other, therefore the terminals 30' received in the terminal grooves 23' face the adjacent terminals 30', which is advantageous for tuning the impendence of the electrical connector 100'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of terminal grooves therein and extending along a mating direction; and a plurality of terminals designated as signal terminals and grounding terminals and respectively received in said terminal grooves in a manner of two neighboring signal terminals adjacent to one grounding terminal which are designated as a terminal group, wherein the grounding terminal and signal terminals which are in a same terminal group face to each other through a path defined therebetween;

wherein a partition wall is defined between adjacent terminal groups;

wherein each terminal comprises a retaining portion secured in the terminal groove and a contacting portion projecting forward, the retaining portions of the grounding terminal and signal terminals which are in a same terminal group face to each other;

wherein the insulative housing comprises a first housing and a second housing stacked together, and the second housing defines a tongue plate therein, said contacting portions of the terminals projecting into the second housing and located at opposite sides thereof beyond the tongue plate.

2. The electrical connector as described in claim 1, wherein a passageway is defined along a transverse direction perpendicular to said mating direction and runs across the terminal grooves.

3. An electrical connector comprising:

an insulative housing;

a plurality of passageways defined in the housing and side by side arranged with one another along a transverse direction while each of said passageways extends in a front-to-back direction perpendicular to said transverse direction; and a plurality of terminals disposed in the corresponding passageways, respectively, said terminals being arranged with a plurality of groups in said transverse direction, each of said groups defining at least one grounding terminal and two signal terminals in sequence so that said grounding terminals and said signal terminals are alternately arranged along said transverse direction; wherein the housing defines a partition wall between every adjacent two passageways in the transverse direction, and some partition walls each of which being located between the two adjacent passageways belonging to the same group, is at least partially removed to directly communicate the corresponding two terminals in said two adjacent passageways, for tuning impedance of said two terminals.

4. The electrical connector as claimed in claim 3, wherein each of the terminals defines a front contacting section and a rear base section, and the partially removed partition wall removes a rear portion between the rear base sections of the two corresponding adjacent terminals while keeping a front portion between the front contacting section between the front contacting sections.

5. The electrical connector as claimed in claim 3, wherein each of the terminals defines a front contacting section and a rear base section, and the partition walls each of which between the two adjacent groups, essentially keeps completeness without removal of a rear portion thereof.

6. The electrical connector as claimed in claim 3, wherein the at least one grounding terminal and the at least two signal terminals communicate with one another in said transverse direction due to removal of rear portions of the corresponding two partition walls each being located between the corresponding two adjacent passageways.

7. The electrical connector as claimed in claim 3, wherein each of said terminals defines a front contacting section and a rear base section, and wherein said base section defines at least one opening to tune impedance thereof.

8. The electrical connector as claimed in claim 7, wherein in each group, the openings of the adjacent two terminals communicate with each other in said transverse direction due to removal of a rear portion of the corresponding partition wall located therebetween.

* * * * *